US006801889B2

(12) United States Patent
Walker

(10) Patent No.: US 6,801,889 B2
(45) Date of Patent: Oct. 5, 2004

(54) TIME-DOMAIN NOISE SUPPRESSION

(75) Inventor: Michael Walker, Baltmannsweiler (DE)

(73) Assignee: Alcatel, Paris (FR)

( * ) Notice: Subject to any disclaimer, the term of this patent is extended or adjusted under 35 U.S.C. 154(b) by 545 days.

(21) Appl. No.: 09/825,335

(22) Filed: Apr. 4, 2001

(65) Prior Publication Data

US 2001/0028713 A1 Oct. 11, 2001

(30) Foreign Application Priority Data

Apr. 8, 2000 (DE) ..... 100 17 646

(51) Int. Cl.[7] ..... G10L 21/02
(52) U.S. Cl. ..... 704/226; 704/225; 375/285; 375/254; 375/346
(58) Field of Search ..... 704/226; 379/416

(56) References Cited

U.S. PATENT DOCUMENTS

| | | | | |
|---|---|---|---|---|
| 6,122,610 A | * | 9/2000 | Isabelle | 704/226 |
| 6,175,602 B1 | * | 1/2001 | Gustafsson et al. | 375/346 |
| 6,507,623 B1 | * | 1/2003 | Gustafsson et al. | 375/285 |
| 6,523,003 B1 | * | 2/2003 | Chandran et al. | 704/225 |
| 6,606,593 B1 | * | 8/2003 | Jarvinen et al. | 704/223 |

FOREIGN PATENT DOCUMENTS

DE 42 29 912 A1 3/1994

OTHER PUBLICATIONS

S.F. Boll, Suppresison of Acoustic Noise in Speech Using Spectral Subtraction, IEEE Transactions on Acoustics, Speech, and Signal Processing, 27:113–120, 1979.*

D. O'Shaughnessy, Enhancing Speech Degraded by Additive Noise or Interfering Speakers, IEEE Communications Magazine, Communications Magazine, 27:46–52, 1989□□.*

"A New Approach to Noise Reduction Based on Auditory Masking Effects" by S. Gustafsson and P. Jax, ITG Conference, Dresden, 1998.

"Psychoacoustics" by E. Zwicker, Springer Berlin, 1982, pp. 51–53.

* cited by examiner

*Primary Examiner*—Nguyen T. Vo
*Assistant Examiner*—Dmitry Brant
(74) *Attorney, Agent, or Firm*—Sughrue Mion, PLLC

(57) ABSTRACT

A process for noise reduction during the transmission of acoustic useful signals includes the following steps of: (a) determining when a speech pause is present; (b) branching the incoming TC signal from the main signal path and utilizing a Fourier transformation to generate a frequency spectrum; (c) storing in a buffer memory (3) the last frequency spectrum recorded during the last speech pause; (d) using an inverse Fourier transformation on the respective last recorded frequency spectrum to generate a simulated noise signal; (e) subtracting the simulated noise signal in the time domain from the current incoming TC signal. As a result, the original signal is maintained uncorrupted up to the actual noise subtraction. With a simple arrangement and less computing effort than before, the process enables an overall acoustic impression to be produced, which is as agreeable as possible to the human ear and which can be matched to individual requirements. Simple optimization to the spectral processing requirements of noise signals can be realized independently of the voice signal processing requirements.

14 Claims, 4 Drawing Sheets

TIME-DOMAIN NOISE SUPPRESSION

BACKGROUND OF THE INVENTION

The invention concerns a process for reducing noise signals in telecommunications (TC) systems for the transmission of acoustic useful signals, in particular human speech.

A known process for noise reduction is so-called "spectral subtraction", that is described in the publication "A new approach to noise reduction based on auditory masking effects" by S. Gustafsson and P. Jax, ITG Conference, Dresden, 1998, for example. This involves a spectral noise reduction method in which an acoustic masking threshold (for example following the MPEG standard) is taken into consideration.

During natural communication between humans, the amplitude of the spoken language is usually adapted to the acoustic environment automatically. In the case of speech communication between distant locations, however, the interlocutors are not in the same acoustic surroundings and each is not therefore aware of the acoustic situation at the location of the other interlocutor. The problem therefore gets worse if, because of his/her acoustic environment, one of the parties is forced to speak very loudly while the other party in a quiet acoustic environment produces voice signals with lower amplitude.

Noise problems are particularly acute in new communication systems applications, for example mobile telephones, in which the terminals are made so small that a direct spatial juxtaposition between loudspeaker and microphone cannot be avoided. Because of the direct sound transmission, in particular structure-borne noise between loudspeaker and microphone the acoustic interference signal can have the same order of magnitude as the useful signal of the speaker at the respective terminal or its amplitude can even exceed this signal. Such a noise problem also occurs to a significant degree in the case of several terminals arranged spatially adjacent to each other, for example in an office or conference room with a number of telephone connections, since a coupling takes place from each loudspeaker signal to each microphone.

Added to this is the problem that on a telecommunications channel "electronically generated" noise also occurs and is transmitted as background along with the useful signal. In order to increase comfort while making a telephone call, one therefore endeavours to keep each type of noise as low as possible in comparison to the useful signal.

Finally, one also endeavours to reduce or completely suppress interference signals such as undesirable background noise (traffic noise, factory noise, office noise, canteen noise, aircraft noise, etc.).

In the known compander process, such as described in DE 42 29 912 A1, the degree of noise reduction is determined by a fixed, predetermined transfer function. First of all, the compander has the property of transmitting voice signals at a specific (previously set) "normal speech signal level" (sometimes referred to as normal loudness) virtually unchanged from its input to the output. If, however, the input signal now becomes too loud, for example because a speaker comes too close to its microphone, then a dynamic compressor limits the output level to virtually the same value as in the normal case, by reducing the actual gain in the compander linearly with increasing input loudness. Due to this characteristic the speech at the output of the compander system remains more or less at the same loudness—irrespective of how widely the input loudness fluctuates. On the other hand, if a signal with a level that is lower than the normal level is now applied to the input of the compander, then the signal is additionally attenuated by reducing the gain in order to transmit background noise that is attenuated as far as possible. The compander thus consists of two partial functions, a compressor for the speech signal levels that are higher than or equal to a normal level, and an expander for signal levels that are lower than the normal level.

In the case of the above-mentioned spectral subtraction, to this end the noise is first measured in the speech pauses and continuously stored in a memory in the form of a power spectral density. The power spectral density is obtained via a Fourier transformation. When speech occurs, the stored noise spectrum is subtracted from the current disturbed speech spectrum "as best current estimated value", then transformed back into the time domain in order by this means to obtain a noise reduction for the disturbed signal.

A disadvantage of such methods is the complicated determination of this acoustic masking threshold and the execution of all computing operations associated with this method. A further disadvantage of spectral subtraction is that due to the process of a basically inaccurate spectral noise estimate and subsequent subtraction, errors which are perceptible as "musical tones", also occur in the output signal.

With extended spectral signal processing, which is also described in the citation mentioned at the beginning, the power spectral densities are estimated for the noise and for the speech itself with the aid of a spectral subtraction. Knowing these partial spectra, a spectral acoustic masking threshold $R_T(f)$ is then calculated for the human ear with the aid of MPEG Standard rules, for example. Using this masking threshold and the estimated spectra for noise and speech, and following a simple rule, a filter passband curve H(f) is calculated, which is configured so that essential spectral components of the speech are transmitted with as little modification as possible and spectral components of the noise are reduced as much as possible.

The original disturbed speech signal is then passed only through this filter to obtain a noise reduction for the disturbed signal by these means. The advantage of this method is now that "nothing is added to or subtracted from" the disturbed signal and therefore errors in the estimations are less perceptible or even scarcely perceptible. A disadvantage is again the considerably greater computing power.

A particular disadvantage of all these known methods is the fact that the incoming original signal undergoes a signal processing process prior to the actual subtraction of a noise signal that is always simulated, and is therefore basically corrupted.

SUMMARY OF THE INVENTION

In contrast, the object of the present invention is to present a process with least possible complexity having the features described at the outset, in which a noise reduction or noise suppression is achieved in an uncomplicated technical manner, and in which the original signal remains uncorrupted right up to the actual noise subtraction. At the same time, with simple means, in particular with less computing power than previously, the process should enable an overall acoustic impression to be produced, which is as agreeable as possible to the human ear and which, according to taste, can be matched to individual requirements. Finally, the new process should be capable of being implemented completely independently of the speech signal processing requirements and thus enable simple optimisation to the spectral processing requirements of noise signals.

This object is achieved according to the invention in both a simple and effective manner by the following process steps:

(a) Determining by means of speech pause detection when a speech pause is contained in the mixture of useful signals and interference signals to be transmitted, or when a speech pause is present;

(b) Branching the incoming TC signal from the main signal path and using a Fourier transformation on the branched TC signal to generate a frequency spectrum of the branched TC signal;

(c) Storing in a buffer memory the last frequency spectrum recorded during the last speech pause;

(d) Using an inverse Fourier transformation on the last respective recorded frequency spectrum to generate a simulated noise signal;

(e) Subtracting the simulated noise signal in the time domain from the current incoming TC signal.

Due to the separate simulation of the noise signal in the frequency domain independently of a processing of the original speech signal, the process according to the invention allows a direct subtraction of the simulated noise signal from the original, uncorrupted input signal, which undergoes neither a Fourier transformation nor an inverse Fourier transformation. With suitable phase correction in the frequency domain, noise subtraction from the original signal is even possible without a time delay. At the same time the process according to the invention is less complex than the above-mentioned known processes from the prior art, requires less computing power and results in a better frequency resolution.

By separating the noise simulation from the transmission of the original signal, the process according to the invention enables, in a particularly preferred variant, in step (d), only a selected part of the generated frequency spectrum to be utilised for the generation of the simulated noise signal. The computing power required for implementing the process according to the invention is thus further minimised or the process itself can be carried out more rapidly.

A development of this process variant is characterised by the fact that the selection of the part of the frequency spectrum used for the generation of the simulated noise signal is made in accordance with psycho-acoustic criteria implementing the mean values of the perception spectrum of the human ear.

In this case the value for the noise signal to be simulated is determined not only from the instantaneous power value of an original signal in speech pauses alone, but also from a weighted spectral characteristic of the corresponding signal and overall, via the function obtained in this way, achieves an acoustically correct noise reduction, that is to say one that is psycho-acoustically pleasant-sounding.

Since there is no measure for an acoustically pleasant-sounding noise reduction, that can be easily represented, all quality assessments rely on extensive listening tests which are then evaluated by means of statistical methods optimised for this purpose, in order to obtain a weighting rule (similar to speech codecs).

The basic procedures for this are to be found in the text book "Psychoacoustics" by E. Zwicker, Springer-Verlag Berlin, 1982, in particular pages 51 to 53, for example.

Due to the psycho-acoustic evaluation, not only can the perceptible quality of the overall signal be optimised, but further savings in the necessary computing power are possible if, for example, masking effects are utilised or only those frequencies that are clearly caused by sources of noise or interference are taken into consideration.

In an alternative development of the above process variant, the selection of the part of the frequency spectrum used for the generation of the simulated noise signal is made in such a way that only discrete frequencies of the spectrum are considered, and that the spacing between the discrete frequencies is made to steadily increase towards the higher frequencies and preferably in accordance with a logarithmic function. The frequency resolution is thus better matched to the perception of the human ear.

These developments can be further improved by dividing the selected part of the frequency spectrum into previously determined frequency groups, and selecting in each frequency group only the frequency or frequency band, respectively, that has the highest signal energy within the frequency group and further utilising this for the generation of the simulated noise signal. This selection achieves a large reduction in the frequencies to be computed for constant audible or perceptible quality, which results in the computing power for the process being further reduced and the quality of the output signal being further enhanced.

If is particularly advantageous if the selection of the frequency or the frequency band, respectively, having the highest signal energy within the frequency group is made prior to step (c) or step (d), respectively. By selecting a specific frequency from a frequency group, differences in the signal energy can be detected very easily.

A process variant in which in step (b) the frequency spectrum of the branched TC signal is generated only in a predetermined frequency band, is also advantageous. Provided the interference source has only a limited frequency spectrum, again considerable computing power can be saved with this measure. For example in powered vehicles, interference sources having a frequency band of up to a maximum of 1 only KHz are considered since the interference signal is in the main formed by low-frequency sound generation (engine, gearbox, motion noise, etc.).

A particularly simple process variant is characterised by the fact that in step (b) and/or step (d) a discrete Fourier transformation or an inverse discrete Fourier transformation is used, where time-discrete amplitude values are sampled from the incoming TC signal at a sampling frequency $f_T$.

In a preferred development of the process variant, a fast Fourier transformation (FFT) is utilised in step (b). If a wide frequency range together with high frequency resolution are to be covered, this procedure allows analysis with lowest computing power. The FFT is then particularly useful if more than 128 frequency lines have to be computed, for example.

Advantageously, an inverse discrete Fourier transformation (IDFT) can be employed in step (d). This allows a signal synthesis to be implemented with lowest computing power if a selected spectrum is processed, since the disadvantage of an equidistant frequency distribution in the FFT is avoided. The IDFT can therefore be advantageously utilised for a specified frequency band. The frequencies can be distributed individually. A saving in computing power with respect to the FFT is possible from a frequency resolution of less than 128 frequency lines.

In the application, savings in the computing power or quality improvements can be achieved if an inverse fast Fourier transformation (IFFT) is employed in step (d). In combination with an FFT in step (b) broadband noise sources can be processed in a particularly economical manner.

An alternative to the last-named process variant is an embodiment in which only the part of the generated frequency spectrum that lies below the half sampling frequency $f_T/2$ is selected. Savings can thus again be made in computing power, but also in memory space utilisation.

Particularly advantageous is a variant of the process according to the invention in which a frequency spectrum that is obtained by averaging the current frequency spectrum generated in step (b) and the previously generated frequency spectra, is temporarily stored in step (c). Due to averaging, spectral lines with higher energy are found and random values or sporadic errors are systematically suppressed.

At the same time, it is particularly favourable if the averaging is carried out with different relative weighting of the currently generated frequency spectrum in different frequency bands. The natural transient response of noise sources can generally be taken into account with such differing directions. For example, the speed of an engine in a powered vehicle cannot usually be suddenly changed. Low-frequency noise sources have a higher transient recovery time than high-frequency ones. In this case the proposed weighting helps to make the adaptivity of a system stable and fast.

Here again it is particularly advantageous if the weighting is realised in accordance with psycho-acoustic criteria implementing the mean values of the perception spectrum of the human ear. As already discussed above, with psycho-acoustic weighting, the frequency-dependent transient times are matched to the auditory sensation of the human ear. An optimisation of the system with regard to naturalness, stability and adaptation time is achieved in this way.

To avoid over-compensation in the treatment of noise, in a particularly preferred variant of the process according to the invention a simulated noise signal weighted with a weighting factor $a<1$ in accordance with predetermined criteria is subtracted from the current incoming TC signal in step (e).

In an advantageous development, the weighting factor a is made a constant value that is dependent on errors in the TC system. This enables the process according to the invention to be optimised to the errors in the respective TC system in a cost-effective and simple manner. If the errors are automatically detected, then the weighting can also take place during operation.

Alternatively, the weighting factor a can be made an adjustable value in accordance with a quality scale which can be selected by the user of the TC system. Such a user-defined weighting factor allows individual, user-defined adaptation of the process according to the invention to the individual requirements. If the system according to the invention is integrated in an existing higher-order concept, a statistical value provided by the user, for example the error probability or detection rate, can be used to control the weighting factor. In the case of applications in powered vehicles, the weighting factor can also be derived from the rotational speed or linear velocity, for example.

This can be further improved by adaptively matching the weighting factor a to the current incoming TC signal. Adaptive weighting allows automatic optimisation of the noise reduction during operation. The weighting factor can be derived from statistical values such as error probability, mean value, changes of state etc. Adaptive weighting allows particularly simple and rapid adjustments to be made to the process according to the invention to suit individual conditions in the acoustic environment of the TC terminal.

A further advantageous variant of the process according to the invention is characterised by the fact that prior to step (e) a synthetic noise signal is mixed with the simulated noise signal generated in step (d). The mixing of an artificial noise signal with constant power density can be used for masking dynamic, non-stationary noise sources in the output signal.

A further variant of the process according to the invention is designed so that prior to step (e) the current incoming TC signal undergoes a specified time delay that is preferably designed so that the phase of the incoming TC signal coincides with the phase of the simulated noise signal prior to subtraction.

Provision is made in an alternative process variant to the effect that the current incoming TC signal is fed for immediate subtraction in step (e) and that prior to step (e) the phase of the simulated noise signal is matched to the phase of the current incoming TC signal. If the phase of the reproduced noise signal in the frequency domain is corrected prior to inverse transformation, the subtraction from the non-delayed signal can take place in the time domain. Disturbing signal delays can therefore be eliminated. These are unavoidable in all processes in which the useful signal (speech) takes the roundabout route via two transformations, as for example in the known spectral subtraction discussed above.

A variant of the process according to the invention in which, in addition to the detection and reduction of noise signals, the presence of echo signals is detected and/or foreseen and the echo signals suppressed or reduced, is particularly preferred. Additional echo suppression is of course only possible when the received original signal from the remote TC subscriber is included in the echo computation. This means that the noise reduction also includes echo generation that is associated with an incoming signal from the remote TC subscriber.

This process variant can be improved by dealing with the control of the reduction of noise signals separately from the reduction of echo signals.

It is also advantageous if during the period of echo reduction a synthetic noise signal is also added to the useful signal, as already discussed in detail above, in order to avoid the subjective impression of a "dead line".

In particular, the synthetic noise signal can include a psycho-acoustic signal sequence (comfort noise) that is perceived as acoustically agreeable.

Alternatively, the synthetic noise signal can include a noise signal previously recorded during the current TC link, which allows a particularly "true-to-life" current acoustical environment to be simulated.

The context of the present invention also includes a server unit, a processor module and a gate-array module supporting the process according to the invention as described above, as well as a computer program for implementing the process. The process can be realised as a hardware circuit as well as in the form of a computer program. At the present time, software programming for high-performance DSPs is preferred, since new know-how and auxiliary functions are easier to implement by modifying the software to existing basic hardware. However, processes can also be implemented as hardware modules, for example in TC terminals or telephone installations.

Further advantages of the invention are revealed in the description and the drawing. The above mentioned features and others to be mentioned later according to the invention can equally be utilised individually or jointly in any combinations. The illustrated and described embodiments are not to be construed as a final list, but rather as having an exemplary nature for the portrayal of the invention.

BRIEF DESCRIPTION OF THE DRAWINGS

The invention is illustrated in the drawing and is explained in further detail with the aid of exemplary embodiments. In the drawing.

DETAILED DESCRIPTION OF THE INVENTION

Figure 1:
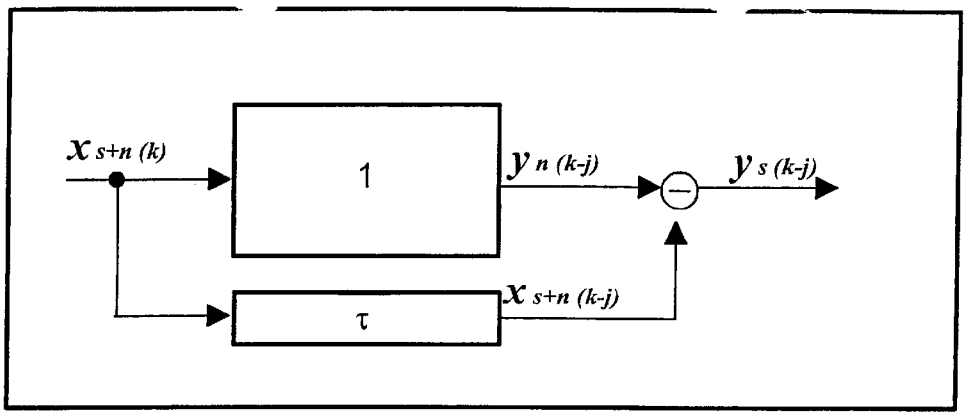
FIG. 1 shows a simple schematic diagram of the mode of operation of a device for implementing the process according to the invention.

FIG. 1 shows how, on the one hand a noise signal $y_n$ in the frequency domain is simulated in a device 1, from an incoming original signal x which contains a speech component s as well as a noise component n, and on the other hand the original signal $X_{s+n}$ is fed to a noise subtraction stage separately from the noise simulation stage, where an optional time delay ô can be implemented. The noise-reduced signal $y_s$ is then forwarded to the TC system.

Figure 2:
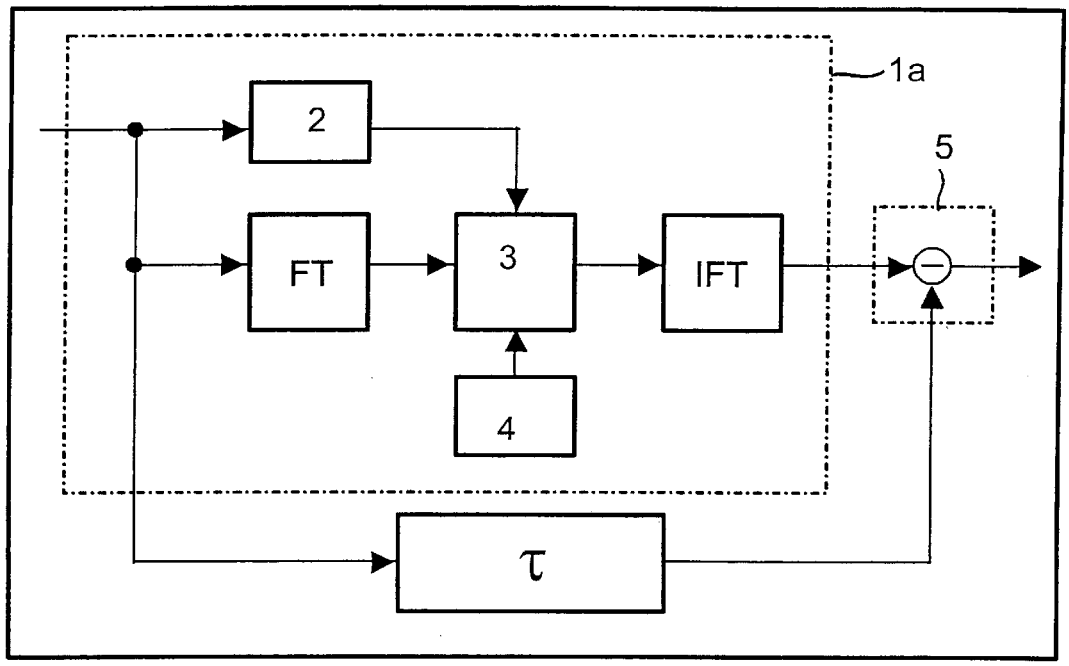
FIG. 2 shows a detailed schematic representation of a device for implementing the process according to the invention.

FIG. 2 shows a simple embodiment in which a speech pause detector 2, which is almost always required in order to determine when the incoming signal may contain speech signals or when a speech pause is present, is provided in the device 1*a* for noise simulation. In parallel with this, the incoming TC signal undergoes a Fourier transformation FT to generate a frequency spectrum and the respective resulting frequency spectrum is stored in a buffer memory 3. The frequency spectra stored in chronological sequence can be averaged by means of a device 4.

As soon as the speech pause detector 2 determines that a speech pause has ended, and speech signals can also be present in the incoming original signal, the frequency spectrum last stored in the buffer memory 3 (optionally averaged with previously recorded spectra) undergoes an inverse Fourier transformation IFT and is subtracted in a subtractor 5 from the original signal that has optionally undergone a time delay ô, in order to obtain a noise-free or at least noise-reduced signal.

Figure 3:
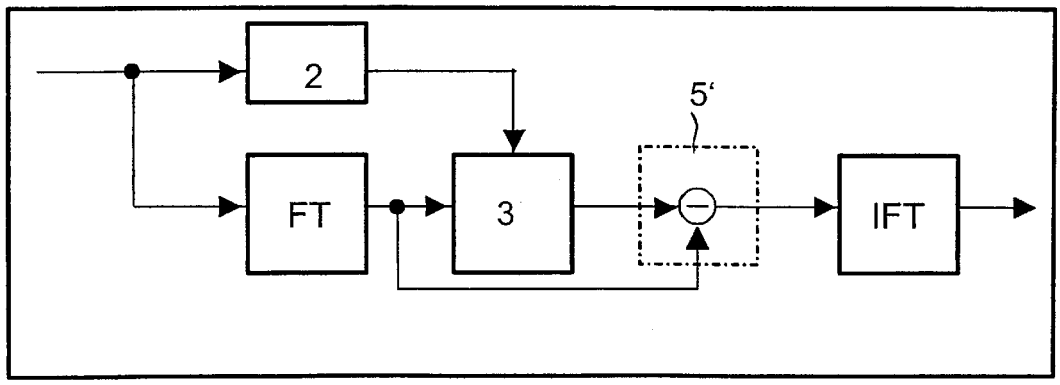
FIG. 3 shows a diagram of a spectral subtraction process according to the prior art.

In contrast to this, in known spectral subtraction processes, the incoming original signal, as shown in FIG. 3, undergoes direct Fourier transformation FT, a simulated noise signal in the frequency domain is subtracted from the Fourier-transformed original signal in a subtractor 5', and the resulting new noise-reduced signal in the frequency domain undergoes an inverse Fourier transformation IFT and transmitted as a noise-reduced TC signal in the time domain. Basically, in the known processes in the prior art, a modification to the original signal therefore always takes place prior to the actual noise subtraction.

Figure 4:
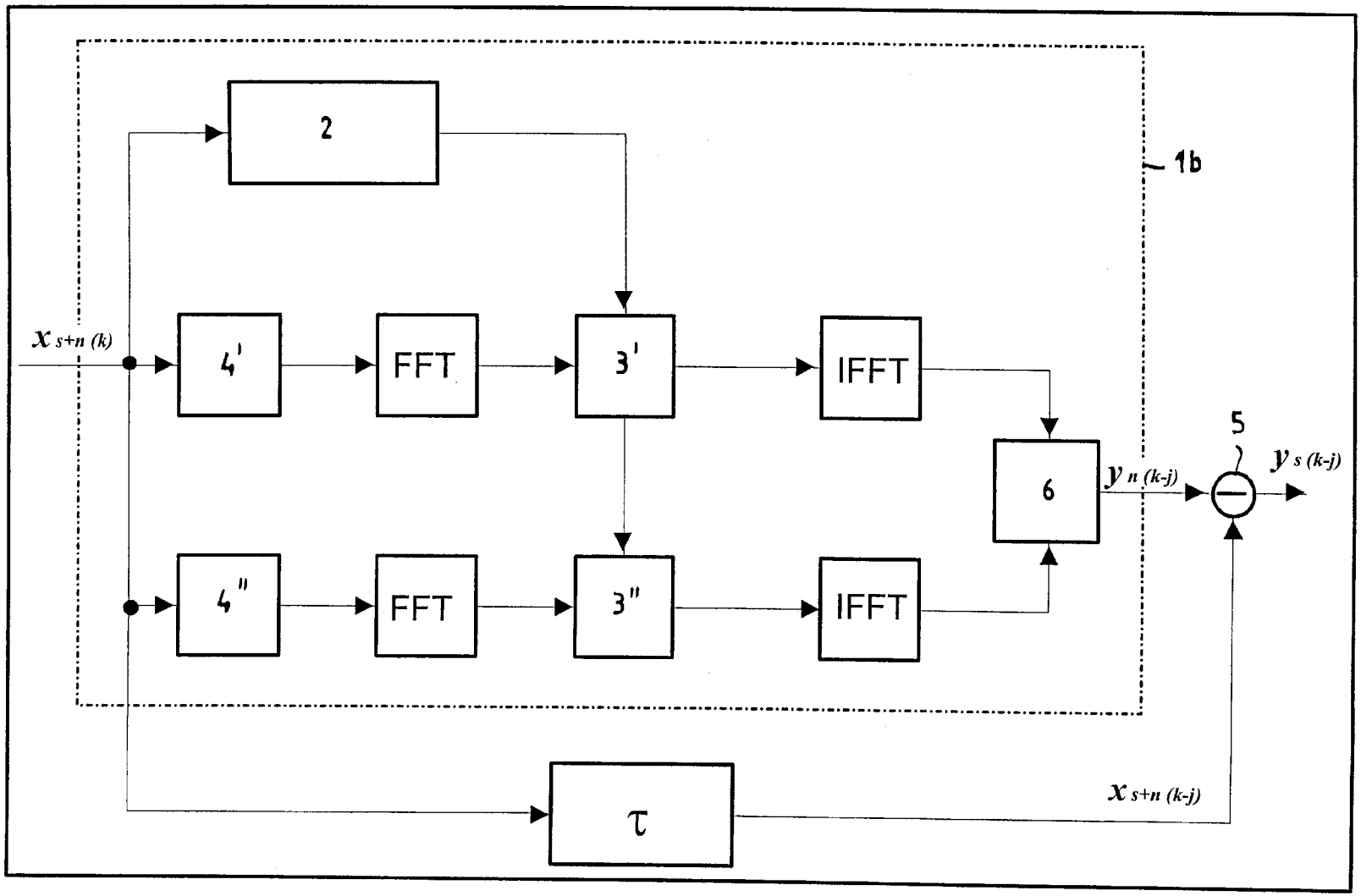
FIG. 4 shows an embodiment of the invention with fast Fourier transformation and fast inverse transformation, as well as block-by-block overlapping processing of the input time signal in the frequency domain.

A further embodiment of the invention in which the incoming original signal $X_{s+n}$ is processed block by block in the device 1*b* for noise simulation, is illustrated in FIG. 4. Here, prior to the transformation into the frequency domain, the time signal undergoes windowing (for example via Hamming) in a suitable upstream device 4' or 4", respectively. In order to compensate errors due to windowing during the inverse transformation, in addition to processing in a first path, parallel processing in a further path is carried out with the same windowing, whereby only the signal is shifted by half the window length and otherwise the noise signal to be simulated is computed with the same means, thereby enabling compensation of the errors generated by windowing to be achieved.

In detail, in the example shown, the windowing is effected in the first path in a device 4', after which the time signal undergoes fast Fourier transformation FFT and the resulting spectrum is stored in a buffer memory 3'. The same happens in the second path via a window device 4" and buffer storage of the Fourier-transformed signal in a buffer memory 3". The buffer memories 3', 3" are followed by an inverse fast Fourier transformation IFFT in each case, and the spectra in the time domain resulting from this are combined in a simulated noise signal $y_n$ in an overlap device 6. The simulated noise signal is then in turn subtracted in the subtractor 5 from an original signal $x_{s+n}$ optionally time-shifted by a time ô, to obtain the noise-free output signal $y_s$. The subtraction of the noise signal from the original signal in the subtractor 5 can undergo phase adjustment.

Figure 5:
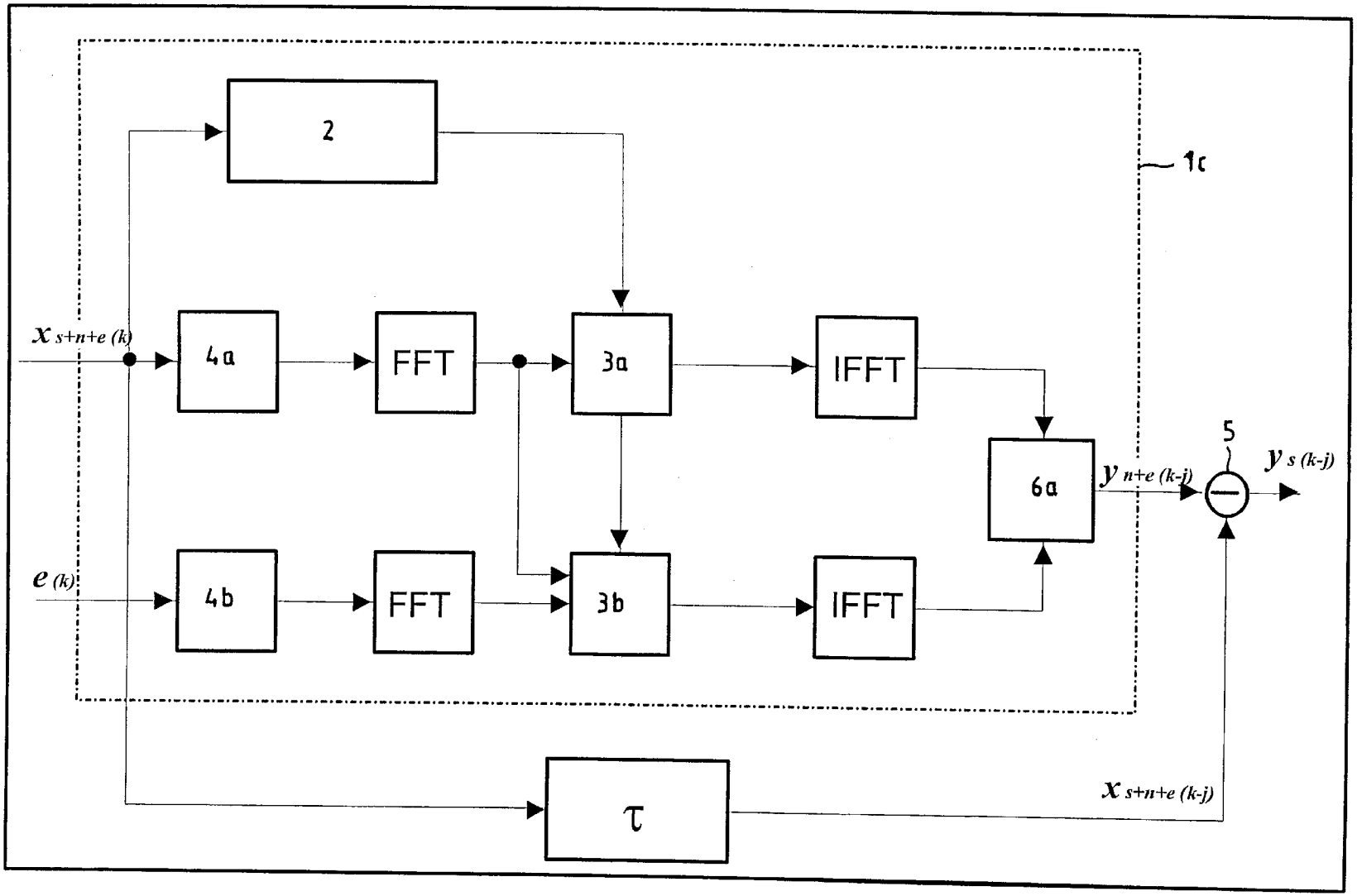
FIG. 5 shows a diagram of an embodiment with simultaneous echo reduction.

A further exemplary embodiment is illustrated in FIG. 5, where the branched incoming TC signal $x_{s+n+e}$ contains speech and noise signals as well as echo signals. An echo signal e is also input in a device 1*c* for noise and echo simulation, which is further handled in a processing path parallel to the noise simulation path.

The incoming original signal $x_{s+n+e}$ first undergoes windowing in a device 4*a*, then a fast Fourier transformation FFT and the frequency spectrum that is obtained is temporarily stored in a buffer memory 3*a*. In parallel with this, the echo signal e likewise undergoes windowing in a device 4*b* and is then Fourier transformed. The frequency spectra of both paths are temporarily stored in a buffer memory 3*b* and may undergo averaging. An inverse fast Fourier transformation IFFT is then carried out separately on the two respective paths. Finally, in a device 6*a*, the simulated noise signal and the simulated echo signal are overlapped into an overall signal $y_{n+e}$ to be subtracted, which is subtracted in the subtractor 5 from the unchanged original signal $x_{s+n+e}$ or the original signal delayed by a time ô, to obtain the noise and echo-reduced TC signal $y_s$.

Figure 6A:
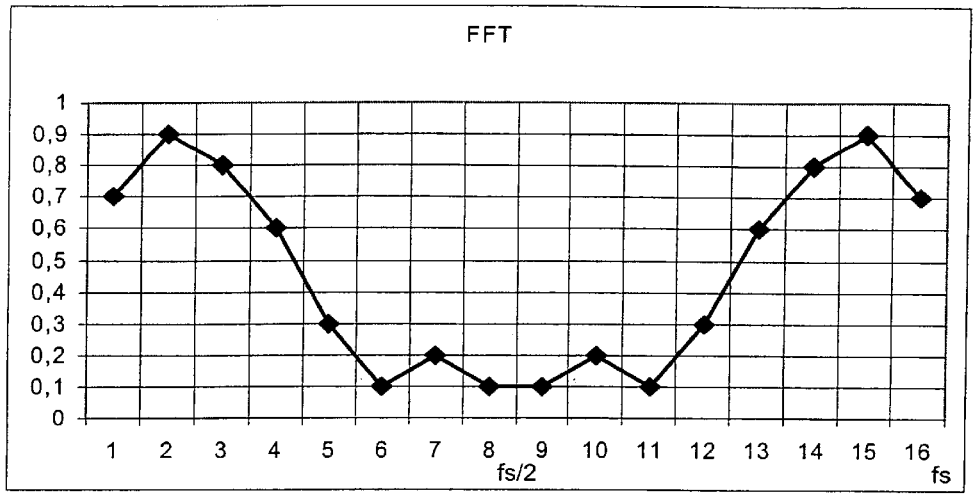
FIG. 6*a* shows an example of a noise signal in the frequency domain computed with FFT.
Figure 6B:
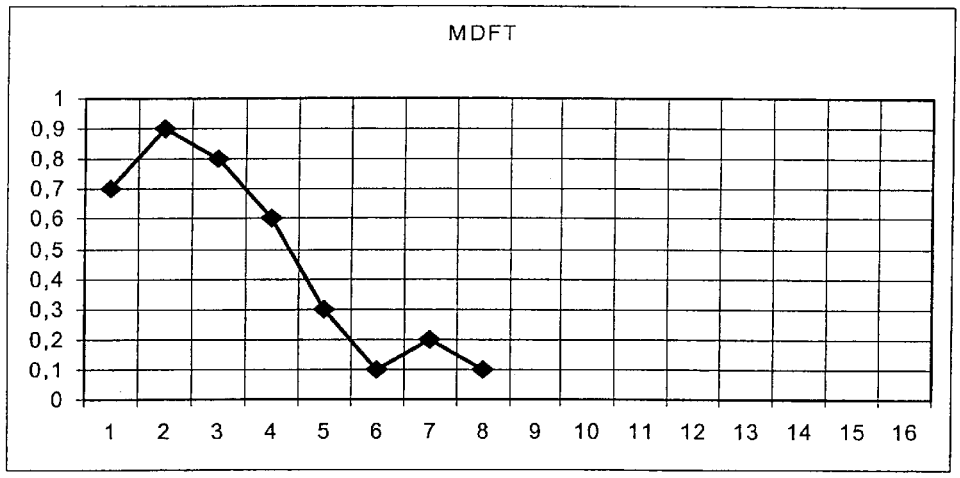
FIG. 6*b* shows a discrete Fourier transformation and noise signal computed only up to $f_s/2$.
Figure 6C:
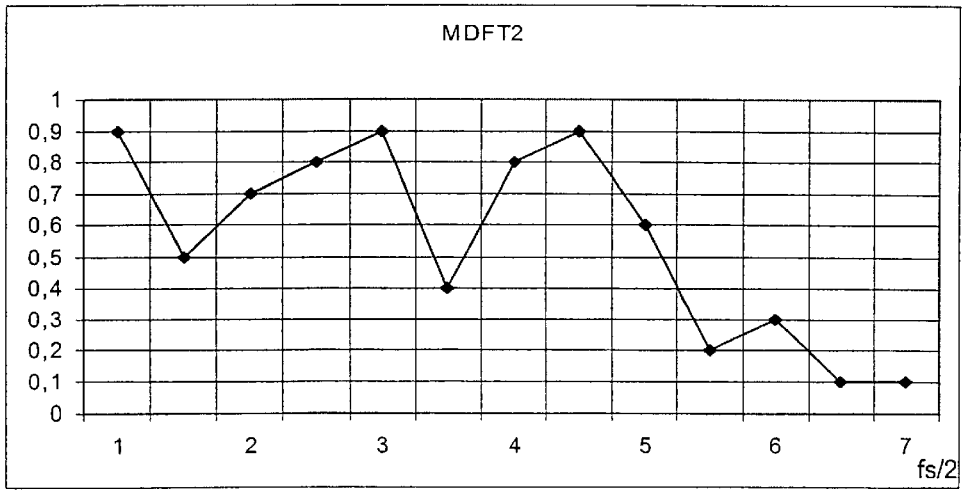
FIG. 6*c* shows a noise signal in the frequency domain up to $f_s/2$ resulting from a modified Fourier transformation with higher resolution.

Finally, FIGS. 6*a* to 6*c* show examples of noise signals in the frequency domain computed in accordance with the process according to the invention. In the example of FIG. 6*a*, in this case the noise to be simulated has been obtained from a fast Fourier transformation FFT. The typical mirror-image symmetry can be seen at the half frequency value $f_s/2$.

However, it also suffices if only the first half of the simulated noise signal in the frequency domain up to the frequency $f_s/2$ is utilised, which is illustrated by an example in FIG. 6*b*, whose result was obtained with the aid of a discrete Fourier transformation.

Finally, FIG. 6*c* shows the result of the use of a modified discrete Fourier transformation at higher resolution, where again only half of the frequency spectrum up to the frequency $f_s/2$ is processed.

What is claimed is:

1. Process for reducing noise signals in telecommunications (TC) systems for the transmission of acoustic useful signals, in particular human speech, with the following steps:

(a) Determining by means of speech pause detection when a speech signal is contained in the mixture of useful signals and interference signals to be transmitted, or when a speech pause is present;

(b) Branching the incoming TC signal from the main signal path and using a Fourier transformation on the branched TC signal to generate a frequency spectrum of the branched TC signal;

(c) Storing in a buffer memory (3) the last frequency spectrum recorded during the last speech pause;

(d) Using an inverse Fourier transformation on the last respective recorded frequency spectrum to generate a simulated noise signal;

(e) Subtracting the simulated noise signal in the time domain from the current incoming TC signal.

2. Process according to claim 1, characterised in that in step (d) only one selected part of the generated frequency spectrum is utilised for the generation of the simulated noise signal.

3. Process according to claim 2, characterised in that the selection of the part of the frequency spectrum used for the generation of the simulated noise signal is made in accordance with psycho-acoustic criteria implementing the mean values of the perception spectrum of the human ear.

4. Process according to claim 2, characterised in that the selection of the part of the frequency spectrum used for the generation of the simulated noise signal is made in such a way that only discrete frequencies of the spectrum are considered, and that the spacing between the discrete frequencies is made to steadily increase towards the higher frequencies and preferably in accordance with a logarithmic function.

5. Process according to claim 2, characterised in that the selected part of the frequency spectrum is divided into previously determined frequency groups, and that in each frequency group only the frequency or frequency band, respectively, having the highest signal energy within the frequency group is selected and further utilised for the generation of the simulated noise signal.

6. Process according to claim 5, characterised in that the selection of the frequency or frequency band, respectively, having the highest signal energy within the frequency group is made prior to step (c) or step (d), respectively.

7. Process according to claim 1, characterised in that in step (b) the frequency spectrum of the branched TC signal is generated only in a predetermined frequency band.

8. Process according to claim 1, characterised in that a frequency spectrum that is obtained by averaging the current frequency spectrum generated in step (b) and the previously generated frequency spectra, is temporarily stored in step (c).

9. Process according to claim 8, characterised in that the averaging with a different relative weighting of the currently generated frequency spectrum is realised in different frequency bands.

10. Process according to claim 9, characterised in that the weighting is realised in accordance with psycho-acoustic criteria implementing the mean values of the perception spectrum of the human ear.

11. Process according to claim 1, characterised in that a simulated noise signal weighted with a weighting factor $a<1$ in accordance with predetermined criteria is subtracted from the current incoming TC signal in step (e).

12. Process according to claim 1, characterised in that prior to step (e) a synthetic noise signal is mixed with the simulated noise signal generated in step (d).

13. Process according to claim 1, characterised in that prior to step (e) the current incoming TC signal undergoes a specified time delay that is preferably designed so that the phase of the incoming TC signal coincides with the phase of the simulated noise signal prior to subtraction.

14. Process according to claim 1, characterised in that the current incoming TC signal is fed for immediate subtraction in step (e) and that prior to step (e) the phase of the simulated noise signal is matched to the phase of the current incoming TC signal.

* * * * *